United States Patent [19]

Dukat

[11] Patent Number: 4,511,444

[45] Date of Patent: Apr. 16, 1985

[54] BACKFILL FOR MAGNESIUM ANODES

[75] Inventor: Alexander J. Dukat, Columbus, Ohio

[73] Assignee: Columbia Gas Systems Service Corp., Columbus, Ohio

[21] Appl. No.: 528,609

[22] Filed: Sep. 1, 1983

[51] Int. Cl.[3] ..... C23F 13/00

[52] U.S. Cl. ..... 204/148; 204/197; 106/DIG. 4

[58] Field of Search ..... 204/147, 148, 196, 197; 106/DIG. 4

[56] References Cited

U.S. PATENT DOCUMENTS

| | | | |
|---|---|---|---|
| 2,480,087 | 8/1949 | Robinson et al. | 204/197 |
| 2,495,466 | 1/1950 | Miller | 204/197 |
| 2,527,361 | 10/1950 | Hunter | 204/197 |
| 2,567,855 | 9/1951 | Pippin et al. | 204/197 |

*Primary Examiner*—T. Tung

*Attorney, Agent, or Firm*—Sidney W. Millard

[57] ABSTRACT

A backfill composition for use with sacrificial magnesium anodes used in the cathodic protection of ferrous metal structures comprises an anion-releasing material capable of releasing fluoride, phosphate or silicate ions in water-soluble form and a magnesium-transporting adjuvant capable of transporting magnesium ion by ion exchange conduction. Suitable anion-releasing materials include calcium fluoride, cryolite, magnesium silicate and sodium silicofluoride, while suitable magnesium transporting adjuvants include bentonite clay, calcium sulfate, calcium carbonate, calcium hydroxide and magnesium silicate. A particularly preferred composition comprises, on a dry basis, by weight, 76.7% calcium hydroxide, 2.3% calcium sulfate, 20% bentonite clay and 1% calcium fluoride.

19 Claims, 1 Drawing Figure

BACKFILL FOR MAGNESIUM ANODES

FIELD OF THE INVENTION

The invention relates to an improved backfill composition for use with magnesium anodes. More specifically, the invention relates to a backfill composition that enhances the efficiency of sacrificial magnesium anodes that are employed in cathodic protection processes for the control of corrosion of steel structures, to a method for improving the efficiency of a magnesium anode and to a magnesium anode assembly comprising a magnesium anode and a backfill composition.

BACKGROUND OF THE INVENTION

It is conventional to protect a buried ferrous metal structure such as a pipeline, tank bottom or other steel or iron structure that is in contact with or partially buried in the earth by means of sacrificial anodes, as for example rods made of magnesium, that are electrically connected as by a wire to the structure to be protected. The principle of operation of such a system is that the presence of the materials, magnesium and iron, within the immediate area of each other within the soil produces an electrical couple wherein the magnesium rod becomes the anode and the steel structure becomes the cathode. Within the electrical couple, the magnesium anode selectively corrodes while a negative charge develops on the steel structure protecting it from corrosion. Corrosion is generally defined as the dissolution of the base material or metal into the surrounding environment. Iron will not generally oxidize in the presence of a negative charge or potential if that potential is sufficiently high. Reference to the electromotive chemical series shows that a potential of −0.68 volts with reference to a saturated Calomel electrode (−0.44 volts with reference to the standard hydrogen electrode), is sufficient to prevent the oxidation of iron from its elemental to an ionic form.

It has been observed that the magnesium anodes are apparently consumed by electrochemical actions other than the electrochemical reaction that protects the steel structure. This reduces the efficiency of such a magnesium anode requiring its earlier replacement. Additionally, a magnesium anode apparently loses its ability to fully protect a steel structure long before the anode is consumed; it has been observed, in many cases, that there is a gradual reduction of the electrical potential of the steel structure to less than −0.68 volts versus a saturated Calomel electrode. For a large utility company attempting to protect miles and miles of buried pipeline or other structures, the cost of replacement of magnesium anodes utilized in the cathodic protection processes is significant. When magnesium rods or anodes require replacement before they are fully consumed and are additionally consumed by processes other than those desired for the protection of the buried steel structure, waste and inefficiency occur. Significant labor and material expenditures are incurred for the untimely replacement of magnesium anodes.

SUMMARY OF THE INVENTION

It has now been discovered that significant increases in the efficiency of magnesium anodes used for cathodic protection can be achieved by the utilization of a controlled backfill composition which comprises a material capable of releasing certain anions which can react with magnesium.

Accordingly, this invention provides a backfill composition for use with a magnesium anode, this backfill comprising an anion-releasing material capable of releasing fluoride, phosphate or silicate anions in water soluble form; and a magnesium-transporting adjuvant capable of transporting magnesium ion by ion-exchange conduction. (The terms "phosphate" and "silicate" are used herein to refer to any water-soluble phosphate or silicate, not merely orthophosphate and orthosilicate.)

This invention also provides a method for improving the efficiency of a magnesium anode comprising contacting at least part of the surface of the anode with a backfill composition comprising an anion-releasing material capable of releasing fluoride, phosphate or silicate anions in water-soluble form.

This invention provides a magnesium anode assembly for use in cathodic protection of ferrous metal structure and comprising a magnesium anode and a backfill composition contacting at least part of the surface of the anode, the backfill composition comprising an anion-releasing material capable of releasing fluoride, phosphate or silicate anions in water-soluble form.

Finally, this invention provides a backfill composition, a method for improving the efficiency of a magnesium anode comprising contacting at least part of the surface of the anode with a backfill composition, and a magnesium anode assembly for use in cathodic protection of ferrous metal structures, this assembly comprising a magnesium anode and a backfill composition, in which the backfill composition comprises, on a dry basis, from about 65 to about 85% by weight of calcium hydroxide, from about 1 to about 8% by weight of calcium sulfate, from about 10 to about 30% by weight of bentonite clay and from about 0.25 to about 10% by weight of calcium fluoride.

BRIEF DESCRIPTION OF THE DRAWING

The accompanying drawing is a schematic representation of a cathodic protection process utilizing a magnesium anode in a backfill composition according to the present invention.

DETAILED DESCRIPTION OF THE INVENTION

Figure 1:
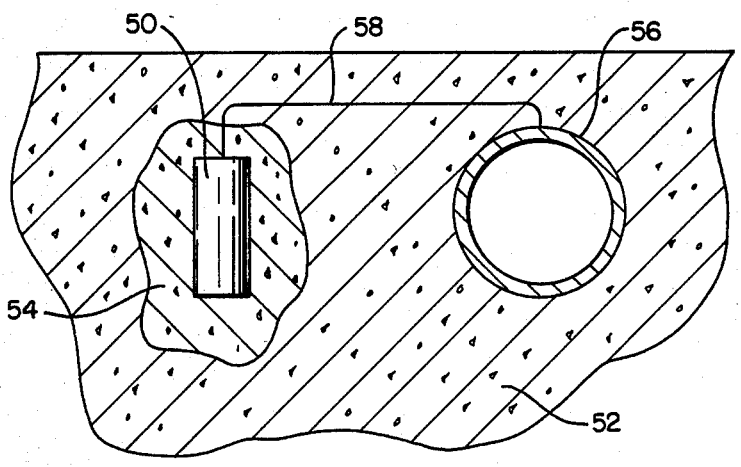

As already mentioned, the instant invention is based upon the discovery that significant increases in the efficiency of magnesium anodes used for cathodic protection can be achieved by contacting at least part of the surface of the anodes with a backfill material containing fluoride, phosphate or silicate anions. It is believed (although the invention is in no way limited by this belief) that the reason for the increase in efficiency of magnesium anodes achieved using the instant compositions and methods is that the fluoride, phosphate or silicate anions released by the anion-releasing material react with magnesium ion liberated at the surface of the anode to produce the corresponding magnesium salts. Magnesium fluoride, phosphate and silicate are only sparingly soluble but are at least an order of magnitude more soluble than the magnesium oxide or hydroxide which, as discussed in more detail below, is the form in which magnesium released from the anode would otherwise be precipitated. Conversion of magnesium to its fluoride, phosphate or silicate thus allows the magnesium to exist, at least for a time, in the form of a sparingly soluble salt which allows slow but consistant migration of magnesium ions away from the surface of the anode, thereby avoiding precipitation of magnesium oxide or hydroxide as a coating upon the surface of the anode.

Preferred anion-releasing material for use in the instant compositions and methods are calcium fluoride, cryolite, magnesium silicate and sodium silicofluoride, calcium fluoride being especially preferred. Other anion-releasing materials may of course be used and such anion-releasing materials may contain the fluoride, phosphate or silicate anions to be released in either a simple or complex form, provided of course that if the anion is originally present in a complex form this complex form is capable of breaking down to yield the simple anion for reaction with magnesium. Thus, the anion-releasing material used in the instant invention may contain fluoride ion as either a simple or complex ion. (Indeed, theoretically, one might employ in the instant invention a covalent fluorine compound which would be hydrolyzed by water present in soil so as to liberate fluoride ion; however, no such covalent compound useful in the instant invention has so far been discovered.) However, it should be noted that, to achieve proper results by means of the instant invention, the fluoride-containing material must produce neither too low nor too high a concentration of fluoride ions adjacent the magnesium anode. Obviously, if the fluoride concentration is too low, not enough of the magnesium being dissolved from the anode will form magnesium fluoride and thus some of the magnesium will end up in the same oxide or hydroxide form on the surface of the anode as if the fluoride had not been present, thus rendering the use of the fluoride-containing material ineffective. On the other hand, it has been found that if the concentration of fluoride ion becomes too high, a layer of sparingly soluble magnesium fluoride is precipitated immediately adjacent and adherent to the surface of the anode, thereby passivating the anode to a very undesirable extent. Passivation is in this instance at least a positive blocking of the magnesium anode surface by the deposited salt, thereby effectively removing such affected surfaces from the cathodic protection process by preventing further ionization of magnesium from those areas. Although no exact numerical range can be given for the useful range of fluoride concentrations, since this range will vary with a variety of environmental conditions, in general it can be stated that the use of highly soluble simple fluorides, such as alkali metal fluorides is not recommended, since such highly soluble fluorides tend to cause passivation of the magnesium anode. It has been found that the best results are obtained using either a sparingly soluble simple fluoride (such as calcium fluoride, which is readily available in the form of the mineral fluorspar) or a complex fluoride which will hydrolyze to liberate significant quantities of free fluoride ion. Suitable complex fluorides include sodium fluoroaluminate, $Na_3AlF_6$, readily available as the mineral cryolite, and sodium silicofluoride. Cryolite has the slight disadvantage that the reaction by which it liberates simple fluoride ion requires the presence of hydroxide ion and is thus pH-dependent so that the effectiveness of cryolite will vary with the pH of the environment surrounding the magnesium anode. Accordingly, if cryolite is to be used to supply fluoride anion in the instant compositions and methods, care should be taken to ensure that the overall composition in which it is employed is slightly alkaline, in order to provide a sufficient hydrolysis of the complex anion to free fluoride, but not too alkaline lest the free fluoride concentration be too large and undesirable passivation occur. As shown in the examples below, a mixture of cryolite with the slightly-alkaline clay bentonite gives good results, while simple mixtures of cryolite with calcium hydroxide or calcium carbonate result in passivation of the magnesium anode.

The instant compositions contain a magnesium-transporting adjuvant, and such an adjuvant is also desirably used in the instant methods and anode assemblies. The magnesium-transporting adjuvant must be a material capable of transporting magnesium ion by ion exchange conditions. Those skilled in the art will be aware that routine methods exist for determining the abilities of materials to transport magnesium ion by ion exchange conduction; for example, if the material to be tested is one containing relatively immobile anions (for example complex silicates such as are found in many clays), the ability of the material to transport magnesium ion may be assessed by washing the material with a concentrated solution of a magnesium salt until substantially all the exchangeable cations have been replaced by magnesium ion, washing the material with water and then measuring the conductivity thereof. Those skilled in the art will also be aware of other methods of measuring the ability of other materials to transport magnesium ion.

The magnesium-transporting adjuvant serves to transport magnesium ion away from the surface of the electrode. Conduction through the material surrounding the anode can occur by two separate mechanisms, namely migration of anions or cations by successive ion exchange reactions, in which the backfill composition functions in an ion exchange mode, or migration of water soluble ion through the backfill composition. In practice, even when the backfill composition if fairly wet, most of the transport of magnesium ion away from the surface of the anode occurs by the ion exchange route, and thus unless the backfill composition is capable of transporting magnesium ion by this route, it is most unlikely that sufficient transportation of magnesium ion can be achieved to remove all the magnesium ion generated at the surface of the anode. Preferred magnesium-transporting adjuvants are bentonite clay, calcium sulfate, calcium carbonate, calcium hydroxide, magnesium silicate and mixtures of these materials. All especially preferred magnesium-transporting adjuvant comprises a mixture of bentonite clay, calcium sulfate and calcium hydroxide.

It will be noted that magnesium silicate can serve as both the anion-releasing material and the magnesium-transporting adjuvant in the instant methods and anode assemblies, and thus (at least in theory) such methods and anode assemblies may be practiced using magnesium silicate alone as the backfill composition. Naturally, we make no claim herein to magnesium silicate per se and thus we make no claim per se to backfill compositions containing magnesium silicate as the magnesium-transporting adjuvant.

In the instant backfill compositions, methods and anode assemblies, the magnesium-transporting adjuvant not only serves to transport magnesium ion but also, like prior art backfill materials, provides a uniform physical environment around the magnesium anode. As those skilled in the art are aware, protection of an iron or steel structure, such as a buried pipeline, with magnesium anodes is usually effected by digging a hole adjacent the pipeline, placing the magnesium anode in this hole, electrically connecting the anode to the structure to be protected and backfilling the hole with a backfill material, typically a mixture of bentonite, calcium sulfate and sodium sulfate. In principle, the instant invention could be practiced by simply adding the appropriate anion-releasing material to the earth removed from the hole before the earth is backfilled into the hole. However, this procedure is specifically not recommended since the physical properties of soils vary so greatly with location that merely adding an anion-releasing material to such a soil will often not produce a proper environment for the magnesium anode. In particular, as described in more detail below, it has been found that heterogeneities in the water-retaining capacity of earth surrounding the magnesium anode produce variations in the electrochemical potential on the anode, thus producing local reactions which reduce the efficiency of the anode. To prevent such local reactions, it is desirable that the magnesium anode be surrounded by a uniform material. Moreover, this uniform material should be one which is capable of retaining water, since the reaction of magnesium with the anion provided by the surrounding material requires the presence of water adjacent the anode. The preferred magnesium-transporting adjuvants described above all provide such a water-retaining, uniform environment for the anode.

As already mentioned, electrical conduction through the instant backfill composition occurs both by ion exchange and by migration of water-soluble ions through moisture in the backfill composition. In order to enhance the initial conductivity of the backfill composition, it is desirable that the instant backfill composition contain a small amount of a water-soluble electrically conductive salt, the preferred salt for this purpose being sodium sulfate. This salt assists in meeting the higher current demands normally experienced with newly installed anodes, but leaches out of the backfill composition over a period of time. Thereafter, the lesser current demands of continued service are met by sparingly soluble materials retained in the backfill composition, including the fluoride, phosphate or silicate ions and the magnesium ions produced by electrolysis and by the residual self-corrosion of magnesium. Obviously, the water-soluble salt used in the backfill composition should be chosen so that you will provide appropriate levels of mobile ions able to migrate through the backfill composition.

For obvious reasons, in the instant invention it is preferred that the backfill composition completely surround the anode in order to protect the whole surface thereof from undesirable side-reactions resulting in loss of efficiency.

Although the proportions of the various components of the instant backfill composition can vary considerably depending upon the exact constituents used and the environmental conditions in which they are to be used, in general it is preferred that the instant backfill composition comprise 10–75% by weight of anion-releasing material and 90–25% by weight of magnesium-transporting adjuvant.

From the foregoing description, it will be appreciated, that, when in use, the instant backfill composition must contain some water. However, this invention extends to the backfill composition in an anhydrous form, since it will normally be convenient to ship the backfill composition in anhydrous form, together with the magnesium anode, to the site at which the anode is to be installed, and to add to the backfill composition a sufficient amount of water to effectively saturate the vicinity of the anode after surrounding the anode with the backfill composition.

In order to ensure that the backfill composition completely surrounds the magnesium anode, it is desirable that the magnesium anode be installed by first digging a hole at the installation site, then placing a layer of backfill composition at the bottom of this hole. The magnesium anode is then placed on top of this layer of backfill composition, connected to the structure to be protected and the remaining hole backfilled with the backfill composition. The preferred installation procedure utilizes a bag filled with the fully mixed backfill material, with the anode already in place centrally within the bag. In this way a hole may be dug at the site of installation. The bag, without being opened, is then lowered into the hole; water is added to fully saturate the contents of the bag. The entire bag and anode assembly is then buried after first making an electrical connection with the pipe or iron structure to be protected. It will be appreciated that the bag must be constructed of either a porous material or at the very least a material that freely allows the passage of electrolyte ions in order to assure good electrical continuity to the circuit and the ability of magnesium products to migrate away from the backfill containing bag.

In order to increase the efficiency of magnesium anodes utilized as sacrificial anodes in a cathodic protection process, the forces and processes by which inefficiencies occur must be understood. Toward this end, anodes were dug from the ground and subjected to analysis. One anode which had been in service in cathodic protection for a period of eight years was recovered along with most of the reaction product from the vicinity of the anode which was adhering to the anode itself. The anode was first sectioned perpendicular to its length, then polished and etched by conventional metallurgical techniques. The grain structure was large and about the same size and configuration as that of a new anode. The thickness of the adhering reaction product was in the range of ⅛ inch to 1/16 inch. X-ray diffraction of the reaction product close to the surface showed that it comprised 60–80% crystalline magnesium hydroxide, and 20–40% crystalline magnesium carbonate trihydrate. Analysis of additional anodes revealed similar corrosion products and the presence of pits which are indicative of localized undesirable side reaction. The presence of pits also has a tendency to break down the geometric unity of the anode reducing the effective area of the anode that may be utilized for cathodic protection and increasing the areas of the anode that may be subject to localized undesirable reactions. Such pits are caused by localized concentration cells in the backfill material against the anode surface producing localized electrochemical reactions that are self-satisfying, that remove magnesium from the anode surface and do not provide electrons to the protected structure for the maintenance of the desired electrical potential. An example of such a reaction is the simple aqueous phase acidic oxidation of magnesium a reaction that generates hydrogen.

$$Mg+2H^{+}=Mg^{++}+H_2 \quad (1)$$

Additionally, the magnesium ion itself is properly viewed as a weak acid: according to the following equation (2), $$Mg^{++}+H_2O=MgOH^{+}+H^{+} \quad (2)$$

Therefore, in an otherwise neutral aqueous phase situation magnesium ions will generate a weakly acid condition which in itself will promote the dissolution of magnesium metal from an anode according to equation (1). However, if one were to begin with a slightly alkaline aqueous-phase situation, then magnesium metal self-corrosion would occur by the following equation:

$$Mg+2H_2O=H_2+Mg^{++}+2OH^-=Mg(OH)_2+H_2 \quad (3)$$

The magnesium hydroxide tends to form an adherent, passivating coating which together with lower hydrogen ion concentration results in near cessation of the self-corrosion process. Electrochemical dissolution of magnesium discharges magnesium ions into the aqueous phase electrolyte in which the affinity of the ion for hydroxide ion drives pH downwardly. A passivating film of oxide or hydroxide does not form if the solution is on the acidic side while such a adherent film does in fact form if this solution is maintained on the alkaline side.

If the aqueous phase electrolyte solution did not contain an anion capable of reacting with or complexing the magnesium ion then in that case no passivating film would be produced and the unrestrained self-corrosion process would continue. It is therefore necessary to introduce into the aqueous phase chemistry materials containing anions which can be released in water soluble form for reacting with or complexing with the magnesium ion to constitute a means to augment the self-passivation process and to indirectly control the pH on the alkaline side at the magnesium anode to electrolyte (backfill) interface.

Anions which form suitable complexes and react with magnesium ions are those containing fluoride ion, phosphate ion and silicate ions. It will be appreciated that there are additional anions available which are capable of forming the necessary insoluble or sparingly soluble products with magnesium ion in an aqueous phase situation.

While it is desirable to achieve a certain degree of passivation, it is undesirable to totally passivate the anode surface and equally undesirable to passivate selective portions of the anode surface while leaving other portions in the unrestrained self-corrosion mode. It is therefore desirable to have the anion which reacts with the magnesium ion to produce a sparingly soluble coating. The aforementioned anions, namely, fluoride, phosphate and silicate, form products with magnesium ion which indeed have these sparingly soluble characteristics.

Additional undesirable reactions occurring at or near the anode to backfill interface include an undue increase in the concentration of magnesium ion in the immediate vicinity of the anode, which increase tends to force the hydrolysis reaction (Equation 1) in an undesirable direction; in the used anodes analyzed, localized drying of the backfill material adjacent the surfaces of the anode removed entire sections of the anode from the electrochemical reactions that are necessary in order to promote cathodic protection of the target steel structure. Therefore the maintenance of backfill integrity so that voids do not occur and so that water is appropriately retained rather than being allowed to drain away will promote the appropriate electrochemical environment for the carrying out of the desired aqueous phase reactions.

The following examples are now given, though by way of illustration only, to show details of preferred compositions, methods and anode assemblies of the invention.

EXAMPLES

A series of tests were performed in which a sample magnesium anode was buried in controlled backfill environments and connected to an iron pipe. See Table I below for the various by weight compositions of backfills that wee tested. The composition designated STD in Table 2 and utilized as a control was a mixture of non-corrosive, chemically-inert materials typical of prior art backfill compositions. Of course it will be appreciated that some soil environments are in themselves rather corrosive being naturally acidic or chemically active. However, the intent of the tests described below was to determine anode efficiencies relative to typical prior art backfill materials which are not specifically designed to effect the type and degree of control provided by the instant backfill compositions.

The soil box tests were conducted using a clear plastic soil box with dimensions 8 inches by 8 inches by 8 inches (20 cm. by 20 cm. by 20 cm.). This cell contained a section of 1½ inch (3.8 cm) OD iron pipe that was positioned toward one side of the box and protruded from both ends of the box. In this way the test was intended to simulate the cathodic protection of an actual pipe section. Magnesium anodes with dimensions ⅜ inch diameter by 4½ inches long (10 mm. by 114.3 mm.) rods each with an initial weight of approximately 13 grams were placed in a water-permeable thimble within the plastic box so that the backfill materials surrounding the small test magnesium anode would not comingle with the earth surrounding the test pipe section. The various backfill compositions of Table I below were placed in the water-permeable thimble along with the anode and, in order to minimize variations between tests the soil and backfill compositions were fully saturated.

FIG. 1 is a schematic representation of a sacrificial anode 50 which has been installed in the ground 52 native to the region in which it is to be applied. The anode 50 has been placed within a compartment of controlled backfill 54, the composition of which is further discussed below. The purpose of the sacrificial anode 50 is the cathodic protection of an underground structure such as buried pipe 56, which is electrically connected via wire 58 to the anode in order to provide electrical continuity and a site for the movement of electrons from the anode to the steel structure cathode.

The current was determined by measuring, with a high impedance voltmeter, the voltage drop across a known resistance in series with the wire connecting the anode to the pipe. In some of the tests, no attempt was made to control the current so that the current level was dictated by cell resistance and voltages. In other tests, the current was controlled to a pre-selected value using a variable resistor connected in series with a wire connecting the anode to the pipe; the pre-selected current level was usually chosen to provide a current density of 25 mA/ft$^2$ on the anode, in order to obtain comparative data in which the known effect of current density on electrochemical efficiencies was eliminated as a variable.

The current density on the surface of the anode was calculated as a function of the square foot area of the anode exposed to the soil. After a period of time the anode was removed from the soil, cleaned of all corrosion products and weighed to determine actual magnesium metal loss. This was compared with the theoretical metal loss based on the current passed between the anode and the protected steel pipe, the only cathodic protection being provided by the current passing through the connecting wire. Efficiency was then measured as a function of theoretical metal loss to actual metal loss.

Table I below shows the experimental results obtained; in this Table the formula $CaSO_4$ is used for convenience to denote gypsum, although of course gypsum is actually $CaSO_4.2H_2O$.

TABLE I

| Example # | Backfill Composition Percent by Weight | | | | Duration (days) | Current Density ($mA/ft^2$) | Anode Efficiency Percent | Anode Efficiency Average Percent |
|---|---|---|---|---|---|---|---|---|
| | Bentonite | $CaSO_4$ | $NaSO_4$ | | | | | |
| 1A | 20 | 75 | 5 | | 8 | 28 | 46 | |
| 1B | | (Control) | | | 8 | 30 | 47 | |
| 1C | | | | | 16 | 27 | 28 | |
| 1D | | | | | 29 | 26 | 45 | |
| 1E | | | | | 29 | 26 | 49 | |
| 1F | | | | | 58 | 25 | 37 | |
| 1G | | | | | 58 | 25 | 46 | |
| 1H | | | | | 30 | 25 | 49 | |
| 1I | | | | | 30 | 25 | 32 | |
| 1J | | | | | 30 | 25 | 41 | |
| 1K | | | | | 30 | 25 | 37 | |
| 1L | | | | | 30 | 25 | 31 | |
| 1M | | | | | 65 | 25 | 25 | |
| 1N | | | | | 120 | 19 | 32 | 39 |
| 10 | | | | | 7 | 101 | 57 | |
| 1P | | | | | 7 | 103 | 58 | |
| 1Q | | | | | 16 | 101 | 76 | |
| 1R | | | | | 29 | 100 | 52 | |
| 1S | | | | | 29 | 102 | 57 | |
| 1T | | | | | 58 | 103 | 56 | |
| 1U | | | | | 58 | 100 | | 60 |
| 1V | | | | | 30 | 104 | 61 | 59 |
| | Bentonite | $CaF_2$ | NaF | | | | | |
| 2 | 20 | 75 | 5 | | Extreme passivation of anode | | | |
| | Bentonite | $Na_3AlF_6$ | NaF | | | | | |
| 3 | 50 | 45 | 5 | | Extreme passivation of anode | | | |
| | Bentonite | $CaF_2$ | | | | | | |
| 4A | 50 | 50 | | | 9 | 24 | 45 | |
| 4B | | | | | 44 | 25 | 60 | 53 |
| 4C | | | | | 12 | 94 | 66 | |
| 4D | | | | | 47 | 79 | 62 | |
| 4E | | | | | 30 | 44 | 62 | 63 |
| | Bentonite | $Na_3AlF_6$ | | | | | | |
| 5A | 50 | 50 | | | 17 | 47 | 87 | |
| 5B | | | | | 31 | 37 | 69 | 78 |
| 5C | | | | | 60 | 28 | 72 | |
| 5D | | | | | 30 | 25 | 52 | |
| 5E | | | | | 30 | 25 | 58 | |
| 5F | | | | | 30 | 25 | 55 | |
| 5G | | | | | 30 | 25 | 49 | |
| 5H | | | | | 30 | 25 | 58 | |
| 5I | | | | | 30 | 25 | 59 | |
| 5J | | | | | 30 | 25 | 57 | |
| 5K | | | | | 30 | 22 | 57 | |
| 5L | | | | | 50 | 20 | 50 | 57 |
| | Bentonite | $CaF_2$ | $Ca(OH)_2$ | | | | | |
| 6A | 20 | 40 | 40 | | 65 | 25 | 39 | |
| 6B | 20 | 20 | 60 | | 65 | 25 | 60 | |
| 6C | 50 | 25 | 25 | | 30 | 25 | 52 | |
| 6D | 25 | 50 | 25 | | 30 | 25 | 52 | |
| 6E | 20 | 60 | 20 | | 65 | 25 | 62 | 53 |
| | Bentonite | $CaSO_4$ | $CaF_2$ | $Ca(OH)_2$ | | | | |
| 7A | 20 | 20 | 30 | 30 | 65 | 25 | 56 | |
| 7B | 10 | 50 | 20 | 20 | 30 | 25 | 54 | |
| 7C | 15 | 58 | 23 | 4 | 30 | 25 | 57 | |
| 7D | 20 | 60 | 10 | 10 | 65 | 25 | 52 | 55 |
| | Bentonite | $CaF_2$ | $Na_2SiF_6$ | | | | | |
| 8A | 20 | 75 | 5 | | 14 | 73 | 59 | |
| 8B | | | | | 29 | 53 | 56 | |
| 8C | | | | | 30 | 23 | 46 | 54 |
| | Bentonite | $Na_3AlF_6$ | $Na_2SiF_6$ | | | | | |
| 9A | 50 | 45 | 5 | | 7 | 91 | 68 | |
| 9B | | | | | 17 | 71 | 69 | |
| 9C | | | | | 28 | 51 | 67 | |
| 9D | | | | | 55 | 34 | 66 | 68 |
| | $CaF_2$ | $Ca(OH)_2$ | | | | | | |

TABLE I-continued

| Example # | Backfill Composition Percent by Weight | | | | Duration (days) | Current Density ($mA/ft^2$) | Anode Efficiency Percent | Anode Efficiency Average Percent |
|---|---|---|---|---|---|---|---|---|
| 10A | 50 | 50 | | | 14 | 25 | 63 | |
| 10B | | | | | 27 | 25 | 62 | |
| 10C | | | | | 46 | 25 | 64 | |
| 10D | | | | | 56 | 25 | 59 | |
| 10E | | | | | 30 | 23 | 60 | |
| 10F | | | | | 30 | 25 | 51 | 60 |
| 10G | 50 | 50 | | | 14 | 100 | 60 | |
| 10H | | | | | 27 | 100 | 67 | |
| 10I | | | | | 46 | 100 | 76 | |
| 10J | | | | | 56 | 100 | 81 | 71 |
| | $CaF_2$ | $CaCO_3$ | | | | | | |
| 11A | 50 | 50 | | | 8 | 23 | 46 | |
| 11B | | | | | 20 | 23 | 28 | |
| 11C | | | | | 35 | 21 | 58 | 44 |
| 11D | | | | | 10 | 74 | 55 | |
| 11E | | | | | 22 | 62 | 51 | |
| 11F | | | | | 29 | 57 | 66 | |
| 11G | | | | | 45 | 51 | 50 | 55 |
| | Bentonite | $Na_3AlF_6$ | $CaCO_3$ | | | | | |
| 12A | 50 | 25 | 25 | | 30 | 22 | 52 | |
| 12B | 20 | 40 | 40 | | 65 | 23 | 56 | |
| 12C | 20 | 20 | 60 | | 65 | 25 | 50 | 53 |
| | Bentonite | $CaF_2$ | $Na_3AlF_6$ | $CaCO_3$ | | | | |
| 13A | 20 | 20 | 20 | 40 | 65 | 25 | 53 | |
| 13B | 20 | 30 | 10 | 40 | 65 | 25 | 50 | 51 |
| | Bentonite | $CaF_2$ | $Na_3AlF_6$ | $CaSO_4$ | | | | |
| 14 | 20 | 10 | 10 | 60 | 65 | 25 | 38 | |
| | $Na_3AlF_6$ | $Ca(OH)_2$ | | | | | | |
| 15 | 50 | 50 | | | | Extreme passivation | | |
| | $Na_3AlF_6$ | $CaCO_3$ | | | | | | |
| 16 | 50 | 50 | | | Partial passivation (low current densities) | | | |
| | Bentonite | $Na_3AlF_6$ | $CaSO_4$ | $Ca(OH)_2$ | | | | |
| 17A | 16 | 20 | 60 | 4 | 30 | 25 | 41 | |
| 17B | 17 | 17 | 62 | 4 | 30 | 25 | 11 | |
| 17C | 15 | 15 | 55 | 15 | 30 | 25 | 18 | |
| | Bentonite | $MgSiO_3$ | | | | | | |
| 18A | 50 | 50 | | | 13 | 25 | 52 | |
| 18B | | | | | 17 | 25 | 52 | |
| 18C | | | | | 29 | 25 | 50 | |
| 18D | | | | | 69 | 25 | 55 | |
| 18E | 50 | 50 | | | 21 | 50 | 60 | |
| 18F | | | | | 37 | 50 | 56 | |
| 18G | | | | | 49 | 50 | 60 | |
| 18H | | | | | 64 | 50 | 59 | |
| 18I | | | | | 21 | 100 | 61 | |
| 18J | | | | | 37 | 100 | 61 | |
| 18K | | | | | 49 | 100 | 59 | |
| 18L | | | | | 64 | 100 | 58 | |
| | Bentonite | $Na_3AlF_6$ | $Na_2SO_4$ | | | | | |
| 19A | 50 | 45 | 5 | | 7 | 104 | 24 | |
| 19B | | | | | 14 | 93 | 20 | |
| 19C | | | | | 32 | 75 | 20 | |
| 19D | | | | | 60 | 57 | 20 | |

CONCLUSIONS

The magnesium anode efficiencies obtained with the prior art composition of Example 1 fell into two ranges, namely a range of 25–49%, averaging 39%, at a current density of 25 $mA/ft^2$, and a range of 50–75%, averaging 59%, at a current density of 100 $mA/ft^2$. The increase in average efficiency with current density was typical of results obtained with prior art compositions.

Examples 2 and 3 illustrate the extreme passivating effects of incorporating a simple, highly-soluble fluoride into the instant composition. The anodes in these two examples were immediately passivated to the point of being completely ineffective.

Examples 4–13 illustrate the increased anode efficiencies obtainable using the instant compositions. Examples 4 and 5 illustrate that mixtures of bentonite with calcium fluoride or cryolite give good results; presumably the mildly alkaline bentonite controls the degree of hydrolysis of cryolite to produce a highly appropriate level of fluoride in the backfill composition. Examples 6–10 show that combinations of calcium fluoride with calcium hydroxide and/or bentonite give good results with or without the optional addition of gypsum and/or sodium silico fluoride. As shown in Example 11, a combination of calcium fluoride and calcium carbonate gives fairly good but not outstanding anode efficiencies; however, this composition was less predictable than others relative to the affect of current density.

Examples 12–17 illustrate that, when cryolite is used as the anion-releasing material in the instant backfill compositions, care must be taken in the selection of the other components. Examples 12 and 13 illustrate that reasonable, though not outstanding results, can be obtained using mixtures of bentonite clay, cryolite and calcium carbonate, with or without the addition of calcium fluoride. Combinations of bentonite clay, cryolite and calcium sulfate with either calcium fluoride or calcium hydroxide (Examples 14 and 17) gave low efficiencies, while a combination of cryolite with calcium hydroxide (Example 15) resulted in extreme passivation of the anode and a combination of cryolite and calcium carbonate (Example 16) resulted in partial passivation of the anode and low current generating capacity. The results in Examples 15 and 16 may be understood by considering the chemical reaction by which free fluoride is liberated from the complex fluoride anion present in cryolite. The high alkalinity caused by the presence of calcium hydroxide, and to a lesser extent, calcium carbonate, results in a high degree of breakdown of the complex anion, yielding a combination of high alkalinity and presence of considerable quantities of soluble sodium fluoride, either of which are capable of passivating the anode. Since the alkalinity is not as high when using calcium carbonate as when using calcium hydroxide, calcium carbonate results in only partial passivation of the anode but still sufficient to render the current densities too low for practical purposes. Similarly, the results obtained in Examples 12, 13 and 17 can be understood by considering the reaction between calcium sulfate and cryolite. Because of the low solubility of calcium fluoride, calcium sulfate and cryolite tend to react to form acidic aluminum sulfate and calcium fluoride. The acidic aluminum sulfate tends to promote self-corrosion of magnesium, thereby lowering the anode efficiency. The proportions of calcium carbonate or calcium hydroxide used in Examples 13 and 17 were insufficient to counteract the acidic environment generated by the gypsum-cryolite reaction. Accordingly, gypsum should only be used in combination with cryolite if one component is present in a minor proportion relative to the other and if sufficient alkaline material, preferably calcium hydroxide is added to counteract the resultant acidic environment. Moreover, since cryolite and gypsum together act as an in situ source of calcium fluoride, it is preferred to use calcium fluoride as the fluoride-releasing material in backfill compositions containing calcium sulfate.

Example 18 illustrates that magnesium silicate is efficacious as an anion-releasing material in the instant backfill compositions.

Example 19 illustrates that an addition of a water-soluble salt, namely sodium sulfate, to the backfill composition is detrimental to anode efficiencies in the early part of the service period of an anode (compare Example 19 with Example 5). This affect is attributable to the high solubility and conductivity of sodium sulfate, which results in domination of current carrying processes by sodium ions and sulfate ions, and a corresponding diminution in the transport of fluoride ions and in their availability for participating in the desired reactions at the surface of the anode. Since sodium sulfate rapidly leaches out of the backfill, this undesirable effect of sodium sulfate is of short duration. However, the disappearance of sodium sulfate from the backfill composition is attended by a diminution in electrical conductivity, and consequently a diminution in current carrying capacity and thus in the corrosion-protecting capability of the anode. The inclusion of the sparingly soluble but long-lived fluoride, phosphate or silicate salts thus serves the additional purpose of maintaining the anode in a moderately conductive state required for a long service life. The inclusion of sodium sulfate in the backfill composition serves the useful purpose of providing the high-corrosion protective capacity immediately at the time of the installation of the anode and sodium sulfate is thus a useful, although temporary ingredient of the backfill composition. The data set forth above in Table I show that substantially improved anode efficiencies can be obtained by the inclusion of fluoride and silicate anions in backfill compositions. The magnitudes of the improvements obtained are such that a magnesium anode with an expected service life of ten years when used in combination with a typical prior art backfill composition, such as that used in Example 1, can be expected to have a service life of 14 to 16 years when used in combination with an instant backfill composition, having regard to the reduced rate of consumption of magnesium. The instant backfill compositions will also provide the further advantage of stabilized anode performance over a multi-year. Because of the long term persistance of the anion-releasing material of the instant backfill compositions, a persistance which serves to maintain the electrolytic properties of the backfill composition at levels needed for stabilized delivery of the requisite ferrous structure protecting current.

Those skilled in the art will appreciate that backfill compositions used to protect magnesium anodes must provide an optimum physical environment, as well as an optimum electrochemical environment. While the data set forth in Table I above indicate that an improved electrochemical environment can be obtained using certain 2-component mixtures (for example a 50:50 mixture of calcium fluoride and calcium hydroxide) it will be evident to those skilled in the art that such compositions cannot be expected to provide an optimum physical environment under the widely divergent ambient moisture conditions experienced when anodes are installed in the field. For this reason, it is normally desirable that the instant backfill compositions include, as the magnesium-transporting adjuvant or in addition thereto, a material designed to provide the optimum physical environment within the backfill composition. Materials which provide appropriate physical environment include bentonite clay, gypsum and mixtures thereof.

The foregoing examples also illustrate that the instant backfill compositions preferably include at least one alkaline material, a preferred alkaline material being calcium hydroxide (hydrated lime) which provides a readily available, inexpensive alkaline material with a reasonably long life expectancy. Thus, in the instant backfill compositions the magnesium-transporting adjuvant is very desirably a mixture of bentonite, calcium sulfate (usually in the form of mineral gypsum) and calcium hydroxide (usually in the form of hydrated lime).

In the light of the data given in Table I above and other test results not reported herein, further consideration was given to the optimum composition of the backfill composition. It appeared from various experimental work that, although the fluoride, silicate or phosphate ion acts as a carrier transporting the magnesium ion from the surface of the anode, much of the magnesium is eventually deposited in hydroxide form within the backfill composition, thereby again liberating the fluoride, silicate or phosphate ion for further reaction with the surface of the magnesium anode. Accordingly, it was realized that the quantity of calcium fluoride in the compositions described above could be considerably reduced without adversely affecting the efficiency of the magnesium anode. Furthermore, although it might at first appear that at pH levels greater than 10 there would be a tendency for almost insoluble magnesium hydroxide to deposit as a passivating coating on the surface of the anode, in practice this was found not to be the case; it is believed (although the invention is in no way limited by this belief) that the reason why magnesium hydroxide does not precipitate at the surface of the anode even when the pH of the backfill composition exceeds 10 is that the magnesium does not leave the surface of the anode in the form of the simple ion $Mg^{++}$, but in some other form, for example $MgF^{+}$ when the backfill composition releases fluoride ion.

Furthermore, not withstanding the role of fluoride, silicate or phosphate ion as a "carrier" to transport magnesium away from the anode, the desired reaction by which the magnesium anode furnishes cathodic protection to the ferrous metal structure may be formulated:

$$Mg+H^{+}+OH^{-}=Mg(OH)^{+}+H^{+}+2e \quad (4)$$

Obviously, this reaction generates one mole of hydrogen ion for each mole of magnesium dissolved, and one mole of hydroxide ions will therefore be required for each mole of magnesium dissolved to neutralize the hydrogen ion generated by the above reaction and to maintain the pH of the backfill composition. Furthermore, a further mole of hydroxide ions per mole of magnesium will be consumed by precipitation of the $Mg(OH)^{+}$ cation as magnesium hydroxide.

Thus, if calcium hydroxide is to be used as the source of hydroxide ion in the backfill composition, one mole of calcium hydroxide will be required for each mole of magnesium to be dissolved i.e. 3.05 parts by weight of calcium hydroxide will be required for each part by weight of magnesium to be dissolved.

The self-corrosion of magnesium occuring in accordance with equation (3) above does not generate hydrogen ions and thus does not consume calcium hydroxide. Accordingly, assuming a typical efficiency of 67% under field conditions, $3.05\times0.67=2.06$ parts by weight of calcium hydroxide will be required for each part by weight of magnesium to be dissolved. In practice, since only about 90% of commercially-available hydrated lime is usable calcium hydroxide, one will need about 2.28 parts by weight of hydrated lime for each part by weight of magnesium to be dissolved from the anode.

It was also determined that the relative amounts of calcium sulfate and calcium hydroxide, when these two components are used together in the backfill composition, should be in proportion to the rates at which these two components are dissolved from the backfill composition during use. Calculations concerning the solubility of gypsum in the presence of calcium sulfate indicate that the molar ratio of calcium hydroxide to calcium sulfate in the backfill composition should be approximately 84:1 i.e. that the backfill composition should contain approximately 36 parts by weight of calcium hydroxide for each part by weight of calcium sulfate. In theory, a similar calculation could be made for the optimum calcium hydroxide:calcium fluoride ratio, but this calculation turns out to be superfluous. The extreme insolubility of calcium fluoride in the presence of calcium hydroxide suggests that only a small fraction of a percent of calcium fluoride would suffice, but the use of such a small proportion of calcium fluoride would lead to extreme difficulty in preparing a homogeneous backfill composition. Although calcium fluoride is significantly more expensive than the other components of the backfill composition, the use of about one percent by weight of calcium fluoride in the backfill composition does not add significantly to the cost of the composition, but does make it much easier to obtain a reasonably homogeneous backfill composition when this composition has to be prepared in the large batches needed for commercial use.

There is no known theoretical basis available for calculating the optimum amount of bentonite clay in the backfill composition. However, the data given in Table I above suggest that a bentonite content of 10 to 30% by weight will give good results.

Having regard to all the foregoing considerations, the presently preferred embodiment of the invention is a calcium hydroxide/calcium sulfate/bentonite clay/calcium fluoride composition having the following ranges of component:

| Component | Broad Range | Preferred Range | Optimum Value |
|---|---|---|---|
| calcium hydroxide | 65–85 | 70–80 | 76.7 |
| calcium sulfate | 1–8 | 1.5–4 | 2.3 |
| bentonite | 10–30 | 10–30 | 20 |
| calcium fluoride | 0.25–10 | 0.5–4 | 1 |

All the figures in the above table are percentages by weight calculated on a dry basis.

For the reasons already mentioned, it is desirable that in the instant anode assembly there be from 1.4 to 3.1, desirably 1.69 to 2.31 and most desirably substantially 2.06 parts by weight of calcium hydroxide per part by weight of magnesium in the anode and that the backfill composition contain from 30 to 40, and preferably about 36, parts by weight of calcium hydroxide per part by weight of calcium sulfate. For a typical commercial 17 pound magnesium electrode, the anode assembly of the invention may thus conveniently contain 35.0 pounds of calcium hydroxide, 1.0 pound of calcium sulfate, 9.2 pound of bentonite and 0.44 pound of calcium fluoride.

EXAMPLE 20

A backfill composition of the invention was prepared from the following components (the percentages are given by weight):

| | |
|---|---|
| Calcium hydroxide (hydrated agricultural lime) | 76.8% |
| Southern bentonite | 20% |
| Calcium sulfate (gypsum) | 2.2% |
| Calcium fluoride (fluorspar) | 1.0% |
| Total | 100% |

The bentonite used was a magnesium-exchange bentonite having a resistivity of 1848 ohm-cm.

This backfill composition was then compared with the prior art backfill composition of Example 1 above in standard experimental pots having a miniature magnesium anode approximately 0.37 inches (9.4 mm.) in diameter and weighing approximately 18 grams. The cathode in the pot was a steel rod and a variable resistor and ammeter were inserted in a wire connecting the two electrodes in order to both control and measure the current produced. All the pots were maintained saturated with water during the tests which lasted for 577.7 hours. The results obtained are shown in Table II below.

TABLE II

| Example # | Anode Starting Wt. g | Final anode wt. g. | Mg loss g | Current Density mA/A$^2$ | Anode efficiency % |
|---|---|---|---|---|---|
| 20A | 18.3194 | 18.2500 | 0.0694 | 4.84 | 60.4 |
| 20B | 18.5567 | 18.4797 | 0.0770 | 4.84 | 54.4 |
| 20C(Control) | 18.6939 | 18.4876 | 0.20263 | 4.84 | 20.3 |
| 20D(Control) | 18.6614 | 18.4608 | 0.2011 | 4.84 | 20.8 |
| 20E | 18.5680 | 18.4170 | 0.1510 | 11.20 | 64.2 |
| 20F | 19.0698 | 18.9186 | 0.1512 | 11.20 | 64.2 |
| 20G(Control) | 18.8563 | 18.5740 | 0.2823 | 11.20 | 34.3 |
| 20H(Control) | 18.5873 | 18.2747 | 0.3126 | 11.20 | 31.0 |
| 20I | 18.6600 | 18.3419 | 0.3181 | 26.03 | 70.8 |
| 20J | 18.8299 | 18.4875 | 0.3424 | 26.03 | 65.8 |
| 20K(Control) | 18.5781 | 18.0491 | 0.5290 | 26.03 | 42.6 |
| 20L(Control) | 18.8319 | 18.2883 | 0.5436 | 26.03 | 41.4 |
| 20M | 18.0509 | 17.3776 | 0.6814 | 60.54 | 76.9 |
| 20N | 18.7943 | 18.0782 | 0.7071 | 60.54 | 74.1 |
| 20O(Control) | 18.1157 | 17.0600 | 1.0557 | 60.54 | 49.6 |
| 20P(Control) | 18.8656 | 17.7794 | 1.0862 | 60.54 | 48.2 |

The data set forth in Table II above show that the instant backfill composition was greatly superior to the prior art composition at all current densities, always having an efficiency at least 50% greater than the prior art composition. The performance of the instant composition was particularly outstanding at low current densities, being approximately three times as great as the prior art composition at a current density of 4.84 mA/ft$^2$ and being almost twice as great as the efficiency of the prior art composition at a current density of 11.20 mA/ft$^2$.

It will be appreciated that numerous changes and modifications may be made in the above described embodiments of the invention without departing from the scope thereof. Accordingly, the foregoing description is to be construed in an illustrative and not in a limitative sense, the scope of the invention being defined solely by the appended claims.

I claim:

1. A backfill composition for use with a magnesium anode comprising on a dry basis from about 65 to about 85% by weight of calcium hydroxide, from about 1 to about 8% by weight of calcium sulfate, from about 10 to about 30% by weight of bentonite clay and from about 0.25% to about 10% by weight of calcium fluoride.

2. A composition according to claim 1 comprising, on a dry basis, from about 70 to about 80% by weight of calcium hydroxide, from about 1.5% to about 4% of calcium sulfate, from about 10 to about 30% by weight of bentonite clay and from about 0.5 to about 4% by weight of calcium fluoride.

3. A composition according to claim 2 having substantially the following composition, on a dry basis by weight:

76.7% calcium hydroxide
2.3% calcium sulfate
20% bentonite clay
1% calcium fluoride.

4. A composition according to claim 1 containing from about 30 to about 40 parts by weight of calcium hydroxide per part by weight of calcium sulfate.

5. A method of improving the efficiency of a magnesium anode comprising contacting at least part of the surface of said anode with a backfill composition comprising on a dry basis from about 65 to about 85% by weight of calcium hydroxide, from about 1 to about 8% by weight calcium sulfate, from about 10 to about 30% by weight of bentonite clay and from about 0.25% to about 10% by weight of calcium fluoride.

6. A method according to claim 5 wherein said backfill composition comprises on a dry basis, from about 70 to about 80% by weight of calcium hydroxide, from about 1.5 to about 4% of calcium sulfate, from about 10 to about 30% by weight of bentonite clay and from about 0.5 to about 4% by weight of calcium fluoride.

7. A method according to claim 6 wherein said backfill composition has substantially the following composition, on a dry basis by weight:

76.7% calcium hydroxide
2.3% calcium sulfate
20% bentonite clay
1% calcium fluoride.

8. A method according to claim 5 wherein said backfill composition contains from about 30 to about 40 parts by weight of calcium hydroxide per part by weight of calcium sulfate.

9. A method according to claim 5 wherein water is added to said backfill composition.

10. A method according to claim 5 wherein substantially the whole surface of said anode is contacted with said backfill composition.

11. A magnesium anode assembly for use in cathodic protection of ferrous metal structures, said anode assembly comprising a magnesium andoe and a backfill composition contacting at least part of the surface of said anode, said backfill composition comprising on a dry basis from about 65 to about 85% by weight of calcium hydroxide, from about 1 to about 8% by weight of calcium sulfate, from about 10 to about 30% by weight of bentonite clay and from about 0.25% to about 10% by weight of calcium fluoride.

12. An assembly according to claim 11 wherein said backfill composition comprises on a dry basis, from about 70 to about 80% by weight of calcium hydroxide, from about 1.5 to about 4% of calcium sulfate, from about 10 to about 30% by weight of bentonite clay and from about 0.5 to about 4% by weight of calcium fluoride.

13. An assembly according to claim 12 wherein said backfill composition has substantially the following composition, on a dry basis by weight:

76.7% calcium hydroxide
2.3% calcium sulfate
20% bentonite clay
1% calcium fluoride.

14. An assembly according to claim 11 wherein said backfill compositoin further comprises water.

15. An assembly according to claim 11 wherein substantially the whole surface of said anode is contacted with said backfill composition.

16. An assembly according to claim 11 wherein said backfill composition provides from about 1.4 to about 3.1 parts by weight of calcium hydroxide per part by weight of magnesium in said anode.

17. An assembly according to claim 16 wherein said backfill composition provides from about 1.69 to about 2.31 parts by weight of calcium hydroxide per part by weight of magnesium in said anode.

18. An assembly according to claim 17 wherein said backfill composition provides about 2.06 parts by weight of calcium hydroxide per part by weight of magnesium in said anode.

19. An assembly according to claim 11 wherein said backfill composition contains from about 30 to about 40 parts by weight of calcium hydroxide per part by weight of calcium sulfate.

* * * * *